United States Patent [19]

Gardner

[11] 4,333,600

[45] Jun. 8, 1982

[54] SIX-CELL PARTITION

[75] Inventor: Jeffrey M. Gardner, Wheaton, Ill.

[73] Assignee: Container Corporation of America, Chicago, Ill.

[21] Appl. No.: 191,313

[22] Filed: Sep. 26, 1980

[51] Int. Cl.[3] ..... B65D 5/48
[52] U.S. Cl. ..... 229/42
[58] Field of Search ..... 229/42, 15

[56] References Cited

U.S. PATENT DOCUMENTS

| | | | |
|---|---|---|---|
| 3,300,076 | 1/1967 | Wohl | 229/15 |
| 3,327,919 | 6/1967 | Kim | 229/42 |
| 4,030,660 | 6/1977 | Rada et al. | 229/42 |
| 4,111,350 | 9/1978 | Hambleton | 229/42 |

*Primary Examiner*—Herbert F. Ross
*Attorney, Agent, or Firm*—R. W. Carpenter; Davis Chin

[57] ABSTRACT

An internal partition device formed of paperboard for forming six cells within an outer container or wrapper.

9 Claims, 7 Drawing Figures

SIX-CELL PARTITION

SUMMARY OF THE INVENTION

This invention relates to internal partition devices for outer containers or wrappers, and in particular to a one-piece partition adapted to provide six cells within an outer container.

It is an object of the invention to provide an internal partition of the type described which requires no gluing, stapling or other securing means to maintain it in erected condition.

Another object of the invention is to provide, in a partition of the type described, an arrangement which includes side or end panels adapted to provide additional stacking strength when containers with similar partitions are stacked one atop the other.

These and other objects of the invention will be apparent from an examination of the following description and drawings.

THE DRAWINGS

Figure 3:
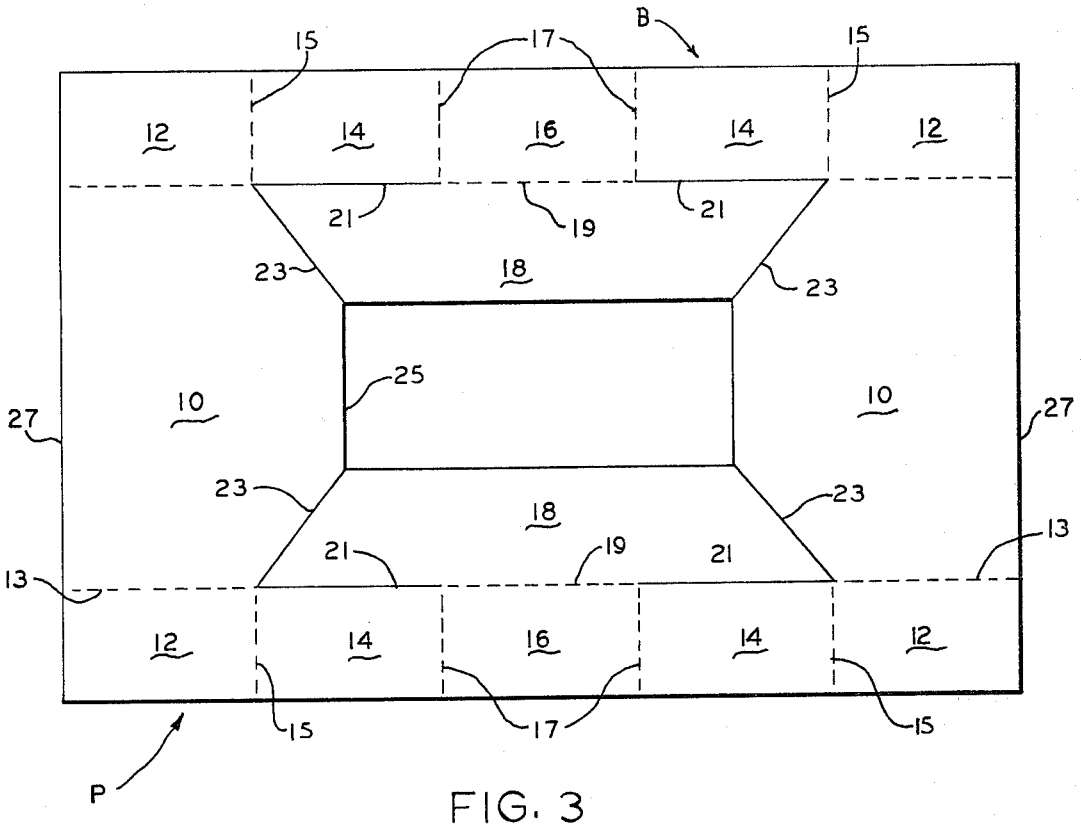
FIG. 3 is a plan view of a blank of foldable sheet material from which the partition illustrated in the other views may be formed.
Figure 1:
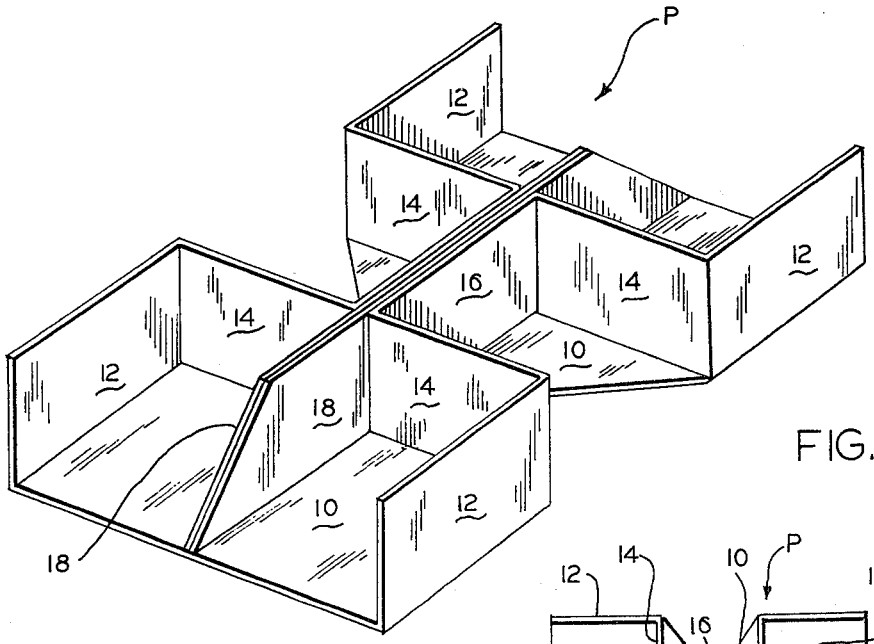
FIG. 1 is a perspective view of a partition embodying features of the invention.
Figure 2:
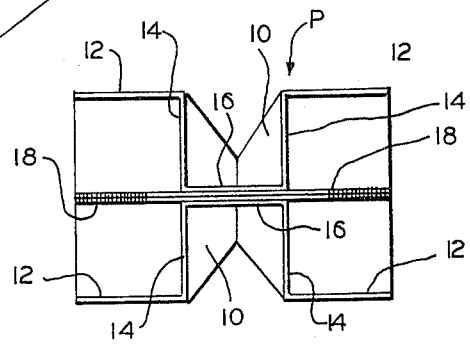
FIG. 2 is a plan view of the structure shown in FIG. 1.
Figure 6:
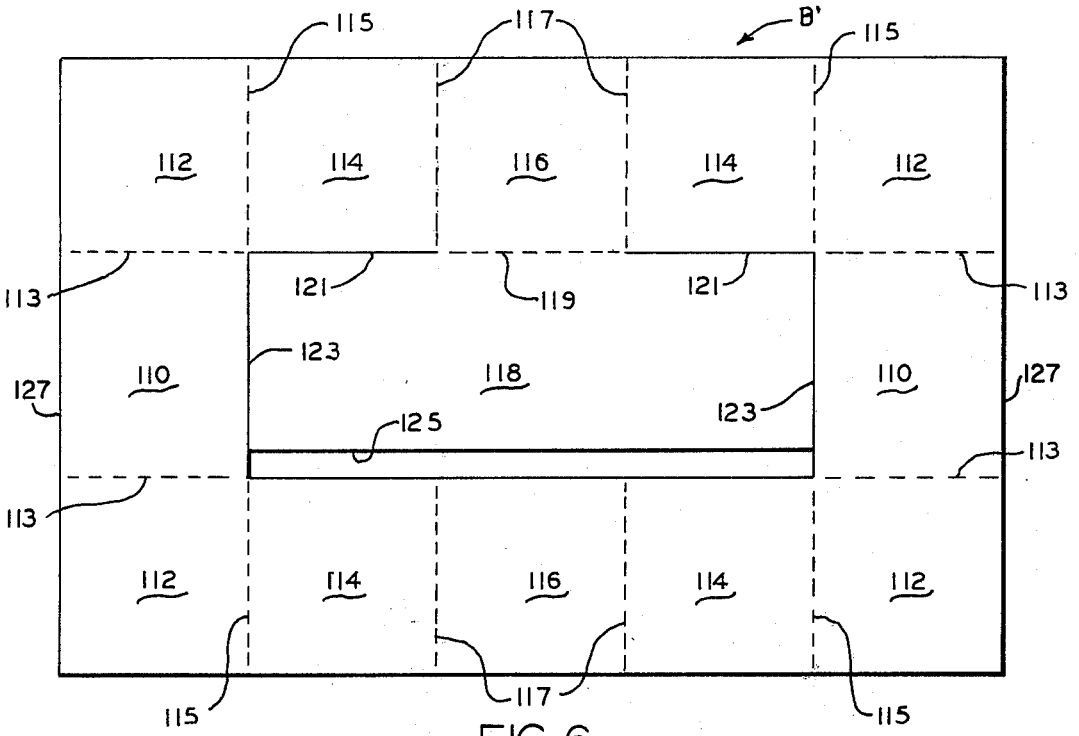
Figure 4:
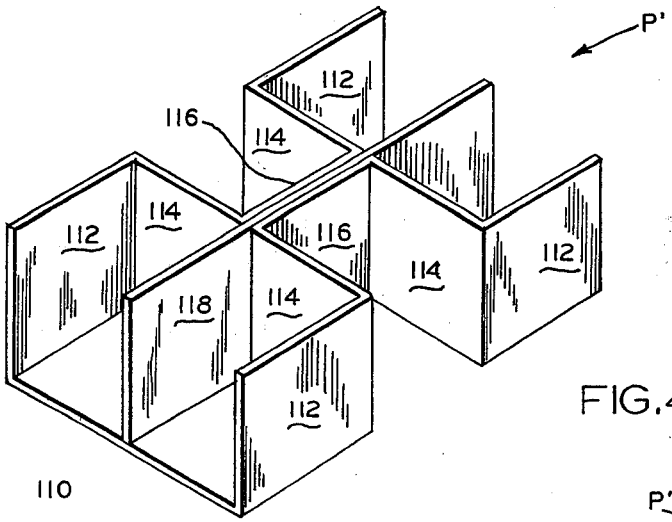
Figure 7:
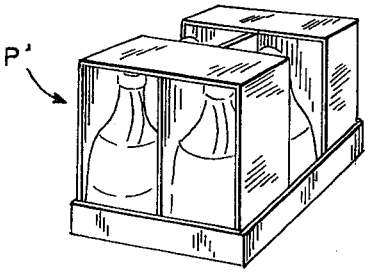
Figure 5:
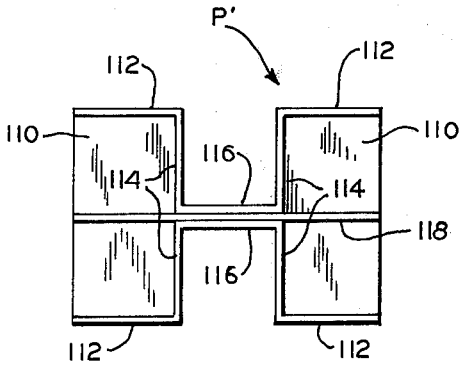

FIGS. 4, 5, and 6 are views corresponding to FIGS. 1, 2, and 3, respectively, but illustrate a modified form of the invention; and FIG. 7 is a perspective view of a partition shown in the erected condition within an outer container or tray and holding articles to be packaged.

It will be understood that, for purposes of clarity, certain elements may have been intentionally omitted from certain views where they are believed to be illustrated to better advantage in other views.

DESCRIPTION OF THE INVENTION

Referring now to the drawings for a better understanding of the invention, and particularly to FIGS. 1 through 3, it will be seen that the six-cell partition device indicated generally at P in FIGS. 1 and 2 may be formed from a unitary blank B of foldable sheet material illustrated in FIG. 3.

As best seen in FIG. 1 partition P includes a pair of co-planar bottom panels 10 which have inboard edges or transverse 25 spaced from each other. At opposed side edges of each horizontal panel 10 are positioned a pair of vertical longitudinal side panels 12 which are foldably joined along corresponding edges on fold lines 13 to the opposite edges of related horizontal panels 10. Each of thehorizontal panels is provided with an outer end edge 27 disposed in parallel relationship to the inboard edge 25.

Extending transversely between opposed side panels are pairs of coplanar vertical transverse panels 14 which are foldably joined at their outer edges along fold lines 15 to inner edges of the related side panels 12.

Positioned generally centrally of the partition intermediate opposed side panels 12 is a vertical longitudinal center partition member 20 which includes a pair of outer panels 16 each of which is foldably joined at opposite side edges on fold lines 17 to the inner edges of related transverse panels 14. Center partition member 20 also includes a pair of inner panels 18 which are foldably joined along fold lines 19 to corresponding inboard edges of outer panels 16. Inner panels 18 are sandwiched between and in parallel relationship with outer panels 16 as shown in FIG. 1.

Inner panels 18 are separated from related transverse panels 14 by cut lines 21 and are separated from related horizontal panels 10 by cut lines 23 which extend diagonally inward to a point where the inner edges of inner panels 18 meet related cut lines 21. The cut lines 23 correspond to transverse edge portions of the horizontal panels.

To erect the partition, the outer panels 18 are folded upwardly at right angles to horizontal panels 10 and at the same time each set of panels transverse panels and inner panels 12, 14 and 16 respectively are folded upwardly at 90° to horizontal panels 10 so that inner panels 16 and transverse panels 14 are in face-to-face relation with inner panels 18. Bottom panels 10 are then moved toward each other at the same time that transverse panels 14 are folded at right angles to inner panels 16 and side panels 12 to provide the structure illustrated in FIG. 1.

Turning now to FIGS. 4 through 7 a slightly modified form of the invention is shown.

In this embodiment portions of the structure which correspond to related portions of the structure of the earlier described embodiment are designated by similar numerals. In this embodiment the partition P′ is formed from a blank B′ shown in FIG. 6.

The primary difference between this structure and that of the previous embodiment is that instead of having a pair of center partition member inner panels there is only one center partition inner panel 118 which is of substantially the same height as the partition member outer panels 116 and the transverse panels 114.

This embodiment is erected in the same manner as the previously described embodiment and may be used with an outer container or wrapping in the position shown in FIG. 4.

Also if desired can provide additional stacking strength the partition may be reversed with the horizontal panels 110 on the top instead of the bottom as shown in FIG. 7.

This provide additional stacking strength when the partition is placed in a container and stacked with like containers in a column.

I claim:

1. An internal partition device, formed of a unitary blank of foldable sheet material such as paperboard, for forming six cells within an outer container or wrapper, comprising:

(a) a pair of co-planar, horizontal panels having outer end edges and corresponding transverse edge portions spaced from each other;

(b) pairs of opposed vertical, longitudinal, side panels foldably joined to and extending normally from opposed side edges of said horizontal panels;

(c) pairs of co-planar, vertical, transverse panels spaced inboardly from outer end edges of said horizontal panels and spaced from each other;

(d) each of said transverse panels being foldably joined at its outer end to an inner end of a related side panel;

(e) a vertical, longitudinal, center partition member positioned intermediate corresponding side panels and including:

(i) a pair of outer panels each being foldably joined at its opposite ends to inner ends of related transverse panels;

(ii) at least one inner panel foldably joined at one edge to an edge of a related outer panel;

(iii) said inner panel being sandwiched between said outer panels in parallel relation therewith.

2. A partition device according to claim 1, wherein said horizontal panels each present a pair of transverse edge portions which converge inboardly.

3. A partition device according to claim 1, wherein said horizontal panels present transverse edge portions which are parallel to each other.

4. A partition device according to claim 1, wherein the combined length of said center partition member outer panel and the two related transverse panels is substantially to the length of said related center partition member inner panel.

5. A blank of foldable sheet material, such as paperboard, which is cut and scored to provide an internal partition device, comprising:

(a) a pair of horizontal panels located at opposite ends of the blank and being spaced from each other and from opposite sides of the blank;

(b) pairs of opposed side panels foldably joined to opposite side edges of each horizontal panel;

(c) pairs of transverse panels foldably joined to inboard edges of respective side panels;

(d) a pair of center partition member outer panels each being foldably joined at opposite end edges to adjacent transverse panels;

(e) at least one center partition member inner panel foldably joined to an inboard edge of one of said center partition member outer panels.

6. A blank according to claim 5, wherein said side panels, transverse panels, and center partition member inner panels are of equal width and are arranged in end-to-end relation on each side of the blank.

7. A blank according to claim 5, wherein said center partition member inner panel is separated from related transverse panels and said horizontal panels by cut lines.

8. A blank according to claim 5, wherein said cut lines form an angle of less than 90 degrees.

9. A blank according to claim 5, where said cut lines form an angle of substantially 90 degrees.

* * * * *